US005084137A

United States Patent [19]

Ilmarinen et al.

[11] Patent Number: 5,084,137

[45] Date of Patent: Jan. 28, 1992

[54] PRESS ROLL WITH DISPLACEABLE END WALLS TO REDUCE PRESS JACKET WEAR

[75] Inventors: Antti I. Ilmarinen, Jyväskylä ; Nils-Erik R. Karlsson; Nils-Erik Säfman, both of Karlstad; Carl Zotterman, Hammarö, all of Sweden

[73] Assignee: Valmet Paper Machinery, Inc., Helsinki, Finland

[21] Appl. No.: 693,314

[22] Filed: Apr. 29, 1991

[30] Foreign Application Priority Data

May 8, 1990 [SE] Sweden ..... 9001630

[51] Int. Cl.[5] ..... D21F 3/08

[52] U.S. Cl. ..... 162/272; 29/113.2; 29/116.2; 29/119; 162/358; 162/361

[58] Field of Search ..... 162/358, 205, 361, 305, 162/272; 100/151-153; 29/113.2, 116.2, 119

[56] References Cited

U.S. PATENT DOCUMENTS

| | | | |
|---|---|---|---|
| Re. 33,034 | 8/1989 | Schiel et al. | 241/119 |
| 4,917,767 | 4/1990 | Ilmarinen et al. | 162/358 |
| 4,917,768 | 4/1990 | Ilmarinen | 162/358 |

*Primary Examiner*—Karen M. Hastings
*Attorney, Agent, or Firm*—Bell, Seltzer, Park & Gibson

[57] ABSTRACT

In order to increase the life of a flexible jacket in a shoe type press roll having a flexible jacket (11), end wall displacing element (28) and jacket stretching element (27), the end wall displacing element (28) are designed to permit a setting of an arbitrary operating position for one roll end wall (18) between two end positions on one of the two stub shafts (13) of the roll, and the jacket stretching element (27) are designed to maintain the stretching force substantially constant, whereby the other roll end wall (22) will be self-positioning and will automatically follow each axial displacment of said one roll end wall (18). Consequently, it will be possible to let the end walls (18, 22) be placed in one end position during a first period of operation and to displace them, for each subsequent period of operation, an adequate distance towards the other end position, whereby the fatigue and the wear of the roll jacket (11), which occur primarily at the axial end of the press shoe (14), will be spread over an area corresponding to the entire displacement distance between the end positions.

14 Claims, 6 Drawing Sheets

PRESS ROLL WITH DISPLACEABLE END WALLS TO REDUCE PRESS JACKET WEAR

The present invention relates to a press roll having a rotatable, liquid impermeable flexible roll jacket, a stationary non-rotatable support beam extending axially through the roll jacket and having a stub shaft at each end, at least one press shoe supported by the support beam and having a concave surface portion, hydraulic means for pressing the concave surface portion of the shoe against the flexible jacket to make the jacket together with a counter roll form a press nip extended in the direction of rotation of the jacket, means for supplying a coolant and lubricant to a surface of the shoe bearing against the jacket, two roll end walls, which are axially displaceable on each of the stub shafts, and both of which have an inner ring member, an outer ring member and a radial bearing for journaling the outer member rotatably on the inner one, fastening means for securing the axial ends of the jacket to each of the outer rotatable end wall members, means for axially stretching the flexible jacket, and means for displacing at least one of the end walls axially on the associated stub shaft for facilitating the securing of the flexible jacket to the end wall.

Such a shoe type press roll for use in presses having an extended nip is previously known, see U.S. Pat. No. 4,625,376 (and U.S. Pat. No. Re. 33,034), for example, and has proved to give several desired advantages in comparison with the type of shoe press that operates with a comparatively long pressing belt. The greatest advantage is that with a shoe type press roll having a flexible jacket it is considerably easier to prevent the jacket coolant and lubricant used, as a rule a mineral oil, from leaking out and contaminating the press felt and paper web. Another advantage is a reduced space requirement. With increased safety against oil leakage which is obtained with a shoe type press roll having a flexible jacket, it will be much easier to make an inverted installation of it, that is an installation in which the press shoe is located on top of the associated counter roll, and an inverted installation makes it possible to achieve further advantages.

However, it has been found that in one important respect a shoe type press roll of the kind disclosed in the above U.S. Pat. No. 4,625,376 is inferior to a shoe press having a longer press belt, namely the life of the flexible roll jacket. Within the pressing zone of such a shoe press roll, the jacket is forced inward by the counter roll into sliding contact with the press shoe. The jacket portion pressed inward into contact with the press shoe will then be situated in an axial line that is located radially inward of a line extending between the peripheral end wall members, which form attachment locations for the edge portions of the jacket, and the radial distance between these lines may be between 20 and 40 mm. Due to this indentation, wear and high local stresses in the jacket result primarily at the axial ends of the shoe when the jacket passes through the pressing zone. The repeatedly occurring stresses in the jacket not only result in a fatigue of the material so that the elasticity of the jacket deteriorates, primarily at the axial ends of the shoe, but also involves large strains on the attachment locations of the jacket at the end walls. The life of the jacket will be too short and the jacket will have to be replaced at regular intervals with concomitant shut-downs and production losses.

The object of the present invention is to improve the design of the shoe type press roll so as to increase the life of the flexible jacket.

In accordance with the present invention, this is achieved with a shoe type press roll of the initially disclosed kind by said end wall displacing means being designed to permit setting an arbitrary operating position for an end wall between two end positions on the stub shaft, and said jacket stretching means being designed to maintain the stretching force substantially constant, whereby the other end wall becomes self-positioning and automatically follows every axial displacement of said one end wall.

In the design shown and described in the above U.S. Pat. No. 4,625,376 the jacket is stretched by a plurality of helical axial compression springs bearing against the axially inner side of each of the end walls. To facilitate the mounting and the attachment of the flexible jacket, which has some thirty tongues at both ends, there is a plurality of axial screws uniformly spaced around the periphery of each stub shaft, by means of which the end walls can be temporarily pressed towards each other under counteraction by the force of the helical compression springs. Consequently, the screws are not intended for setting an arbitrary operational position of the adjacent end wall. If they, nonetheless, were to be used for this purpose, it would result in a marked change in the stretching force acting on the jacket, because the thrust from a helical compression spring changes markedly with the degree of compression of the spring.

Since the flexible jacket can be displaced axially to an arbitrary operational position between two end positions, it becomes possible to displace the jacket axially in relation to the support beam and the shoe, after a first operational period, a distance that is sufficient for carrying the most fatigued portion of the jacket away from the axial end of the shoe and for carrying a jacket portion, which has been exposed to a lower degree of fatigue, forward to said shoe end. This adjustment of the position of the jacket in relation to the support beam and the shoe may be carried out several times until the entire displacement distance between the end positions has been utilized. In this way a marked increase of the life of the jacket is obtained.

Preferably, said jacket stretching means include means for pressurizing the flexible shell by a comparatively low, constant but variable internal pressure above that of ambient atmosphere. Such means may include a source of pressurized air, which is able to keep the jacket inflated to an at least substantially circularly cylindrical shape by means of an internal sure higher than that of ambient atmosphere by 0.03–0.1 bars (3–10 kPa). An overpressure of this size will give an axial stretching force acting on the jacket, and at a jacket diameter of 1.4 m and an end wall inner diameter of 0.7 m this force will be between 4 and 12 kN. At the specified upper limit of the overpressure the pressure difference is sufficiently large for drawing off cooling and lubricating oil, which has been removed from the inner side of the jacket at a bottom region thereof, out of the roll through one of its stub shafts. At the lower limit suction is required, e.g. by sub-atmospheric pressure in a return oil tank.

Said jacket stretching means preferably also include pressure medium operated means, which are supplied with constant pressure and are operatively connected between the support beam and the inner ring member of said other end wall, for adjusting a force on said other end wall caused by the internal pressure so as to maintain a predetermined axial tension in the jacket when said one end wall is being displaced as well as when the internal pressure is being adjusted. Thereby, the axial tension in the jacket may be maintained at a selected, suitable level irrespective of the magnitude of the stretching force originating from the internal pressure. Consequently, the pressure medium operated means can act on the end wall with a force that increases the force from the internal pressure or that counteracts it, all according to what is required.

Suitably, the pressure medium operated means include at least two hydraulic actuators connected parallel to each other and mounted axially on the support beam, said actuators being spaced by equal size angles of rotation in relation to the rotatable roll jacket and including piston rods. Each of the piston rods is provided with a piston rod extension, each piston rod extension extends through a guide mounted axially on the support beam, and the inner ring member of said other end wall has a radially outwards extending flange, to which the piston rod extensions are attached.

Preferably, the press roll further is of a design such that the support beam between its stub shafts is a box beam, and such that the end wall displacing means include a rotatable operating screw mounted axially inside the box beam, a nut member secured against rotation and movable on the screw, two rods fixed to the inner ring member of said one end wall at diametrically opposed positions and extending axially into the box beam up to the nut member, and two arms, each of which connects one of said rods with the nut member, so that a rotation of the operating screw will displace the nut member, the arms and the rods and, thereby, also said one end wall axially on the stub shaft.

Then it is suitable that the operating screw has an outer end extending axially out through a hole provided in the stub shaft, and that said end is shaped to be engaged by a drive means for rotating the screw. It is also suitable that the box beam has an end wall, further that the stub shaft has a radial flange screwed on to the end wall, and that two guide bushings for the two rods extend through the box beam end wall and the flange. In this way a comparatively simple design is achieved that gives a reliable action.

To reduce the strains on the flexible jacket at its ends, where it is attached to the roll end walls, it is suitable that the fastening means for securing the axial ends of the jacket to each of the outer rotatable end wall members include end wall portions defining a circular groove provided in the inner side of the outer ring member of each of the two end walls for receiving the edge portion of the flexible jacket and a plurality of circularly arched locking elements, said groove and each of said locking elements being provided with cooperating tapered surfaces, and means for pulling the locking elements into the groove and retaining them therein in order to clamp the edge portion of the jacket in the roll end wall by wedge action. This also provides the advantage that the jacket will be easier to attach and an exchange of the jacket will be facilitated. Suitably, the groove tapers inward towards its bottom and at least a major portion of the radially inner side wall of the groove is parallel to the roll jacket. Further, it is suitable that the outer ring member of each of the two roll end walls includes a radially inner ring and an outer ring, which preferably is segmented to form a plurality of identical circularly arched sections and is of a substantially L-shaped cross section and is attached by screws to the inner ring to form the groove between the inner ring and an axially extending collar of the outer ring, and that a radially inward extending flange of the outer ring has an axially protruding projection while the inner ring has a matching recess for locating the two rings radially relative to each other.

Preferably, the radial bearing is selected so as to permit a certain limited tilting of the outer ring member of the roll end wall in relation to the inner ring member thereof, whereby a difference in tension in the flexible jacket at the pressing zone and at a diametrically opposite location is reduced, which contributes to the increasing of the life of the flexible jacket.

In order to increase the life of the jacket, it is also suitable that the press shoe has a plurality of hydrostatic pressure pockets located side by side. Hereby, both the lubricating effect and the cooling effect are improved. An additional improvement is obtained on one hand by making land surfaces located upstream and downstream of the hydrostatic pressure pockets be of a sufficient width in the direction of rotation of the jacket to make the press shoe be of a combined hydrostatic and hydrodynamic type, and on the other hand by making other land surfaces, which separate adjacent pockets, extend at an oblique angle in relation to a plane that is perpendicular to the rotational axis of the roll jacket.

BRIEF DESCRIPTION OF THE DRAWINGS

The invention will be described more in detail below with reference to the appended drawings.

The preferred embodiment of the shoe type press roll illustrated in the appended drawings has a rotatable liquid impermeable flexible roll jacket 11, which may be of conventional type and consists of reinforced polyurethane, for example. It has a plain inner side, and the outer side of the jacket may be provided with a plurality of peripherally extending grooves, but preferably also the outer side is plain.

Figure 2:
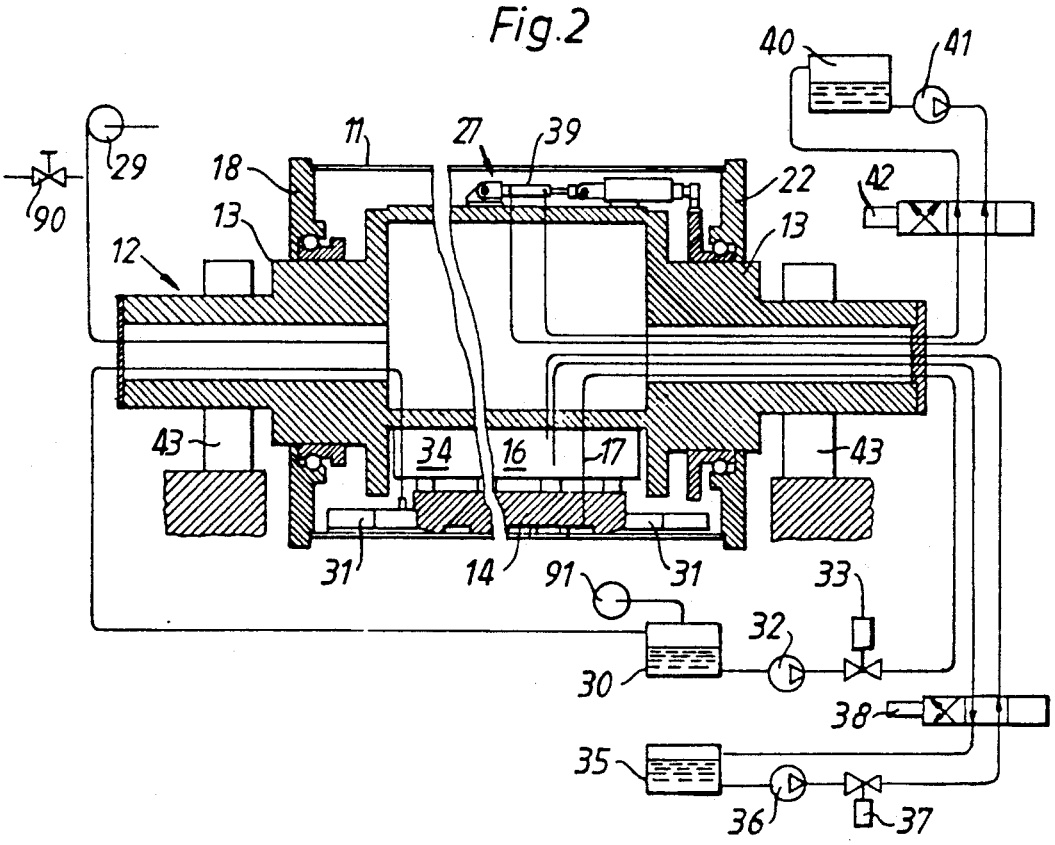
FIG. 2 is a schematic longitudinal cross sectional view of a preferred embodiment of the shoe type press roll according to the invention provided with a schematically illustrated control system.

As seen in FIG. 2, a stationary non-rotatable support beam 12 having a stub shaft 13 at each axial end extends axially through the flexible roll jacket 11. The support beam 12 supports at least one press shoe 14 having a concave surface portion 15. In the preferred embodiment illustrated in the drawings the press shoe essentially is of the principle design disclosed in U.S. Pat. No. 4,917,768.

Figure 1:
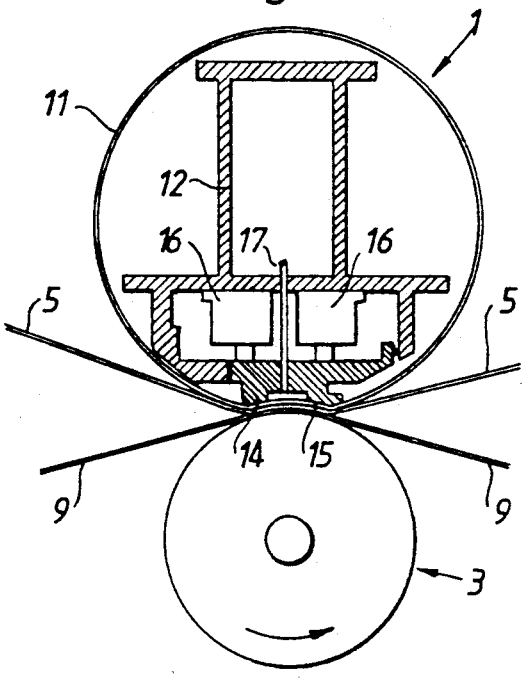
FIG. 1 is a schematic cross-sectional end view of a single felted wet press having an extended press nip formed between a shoe type press roll in accordance with the present invention and a counter roll.

Further, the shoe type press roll is provided with hydraulic means, generally designated 16, for pressing the concave surface portion 15 of press shoe 14 against the flexible jacket 11 in order to make the jacket together with a counter roll 3, as illustrated in FIG. 1, form a press nip that is extended in the direction of rotation of jacket 11. The counter roll 3 suitably is a controlled deflection roll, preferably such a one that Valmet Paper Machinery Inc. markets under the trade mark SYM-Z roll. FIG. 1 also illustrates that in the most preferred embodiment the press is inverted, that is the press shoe 14 presses in a downward direction towards the subjacent counter roll 3. This makes it possible to design the press as a single felted press with the intended printing side of the paper web bearing against the plain jacket of the counter roll, and in FIG. 1 reference numeral 5 designates a press felt loop and 9 the paper web. In addition, FIG. 1 shows that shoe type press roll 1 also includes means, generally designated 17, for supplying a coolant and lubricant to the press shoe surface that bears against flexible jacket 11.

Figure 3:
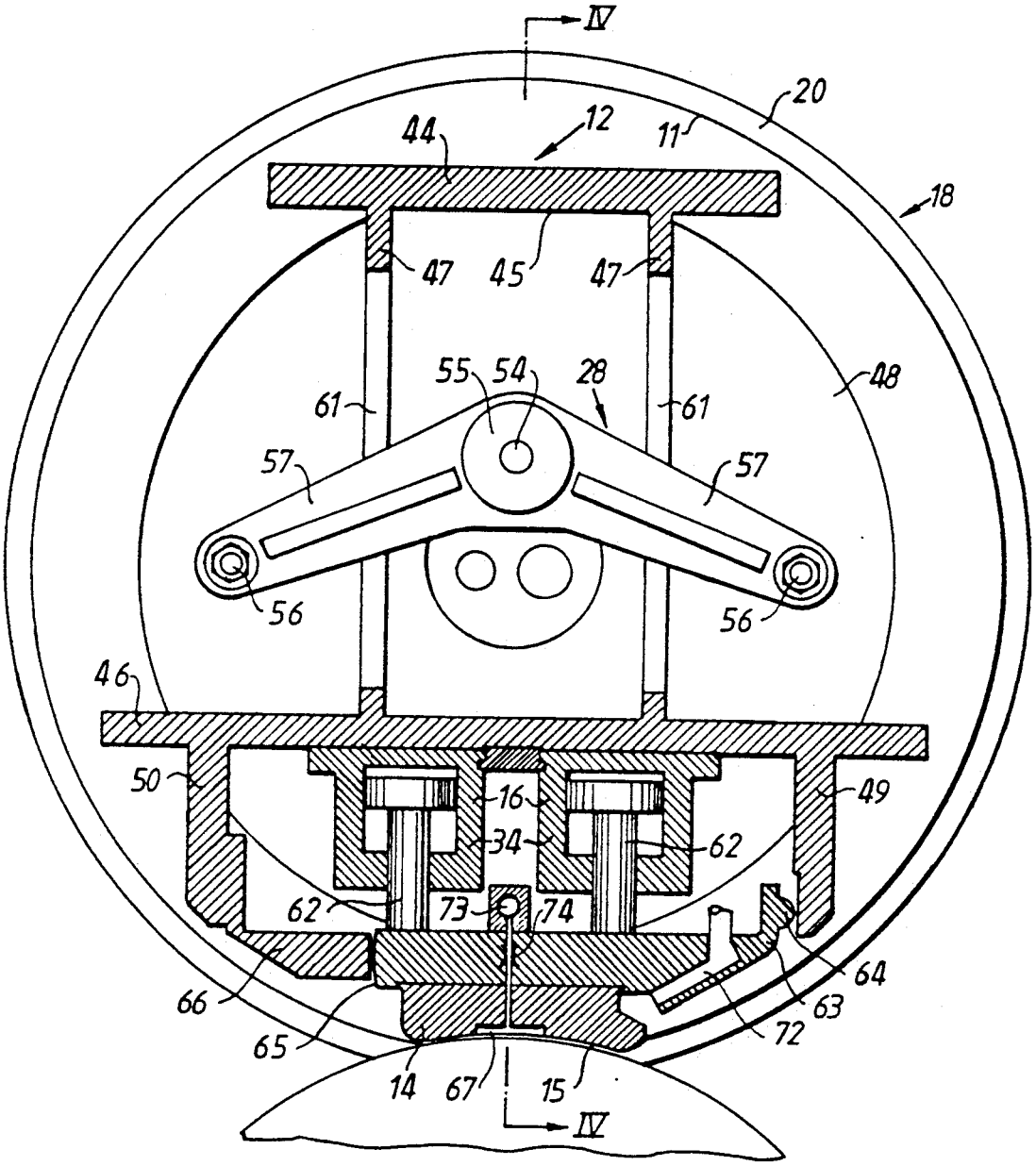
FIG. 3 is a cross sectional view taken upon line III—III in FIG. 4A.
Figure 4A:
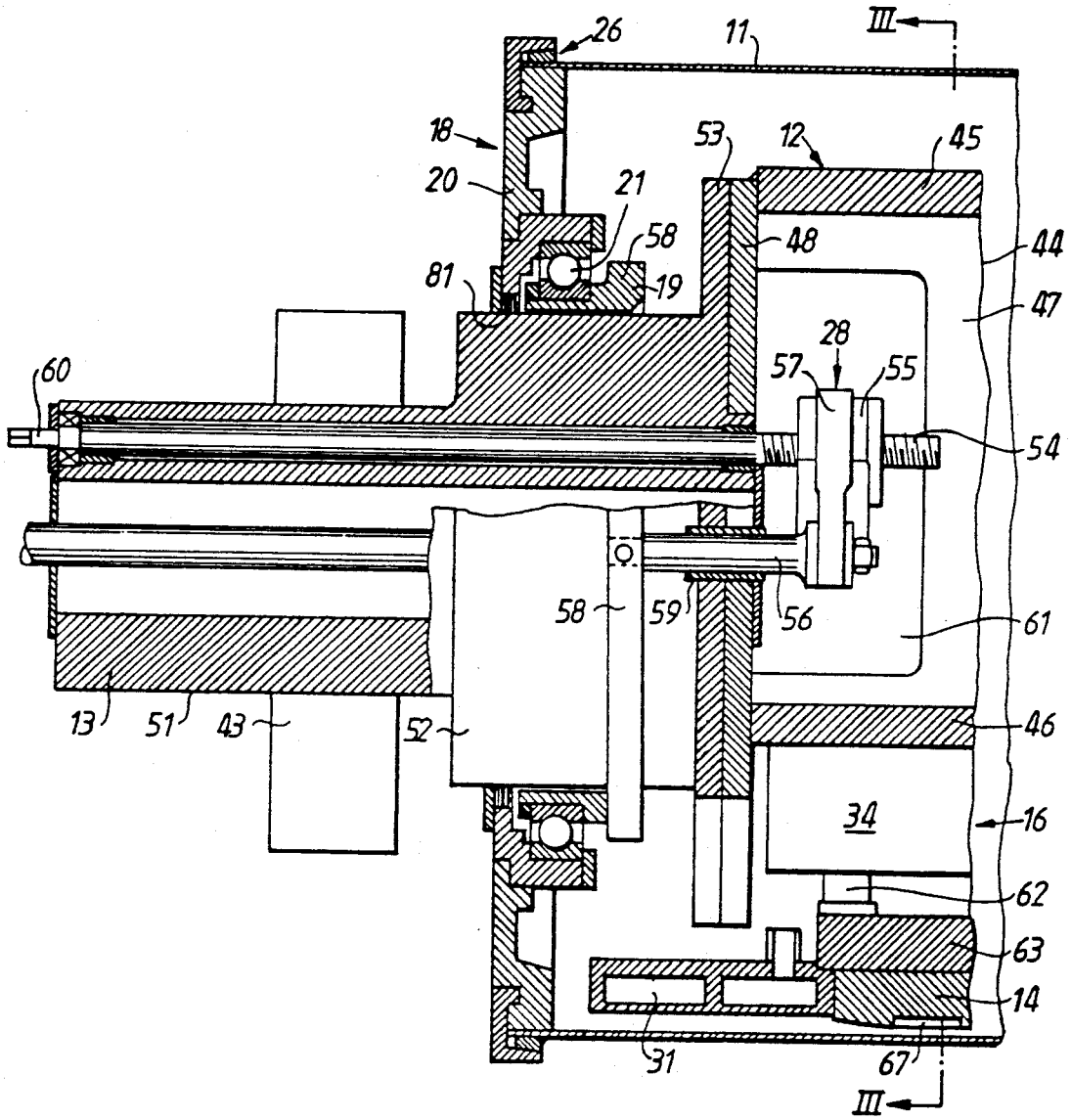
FIG. 4 is a longitudinal sectional view of the shoe press roll, which for considerations of space is divided into FIG. 4A on one drawing sheet and FIG. 4B on another, said longitudinal section being taken on line IV—IV in FIG. 3.
Figure 4B:
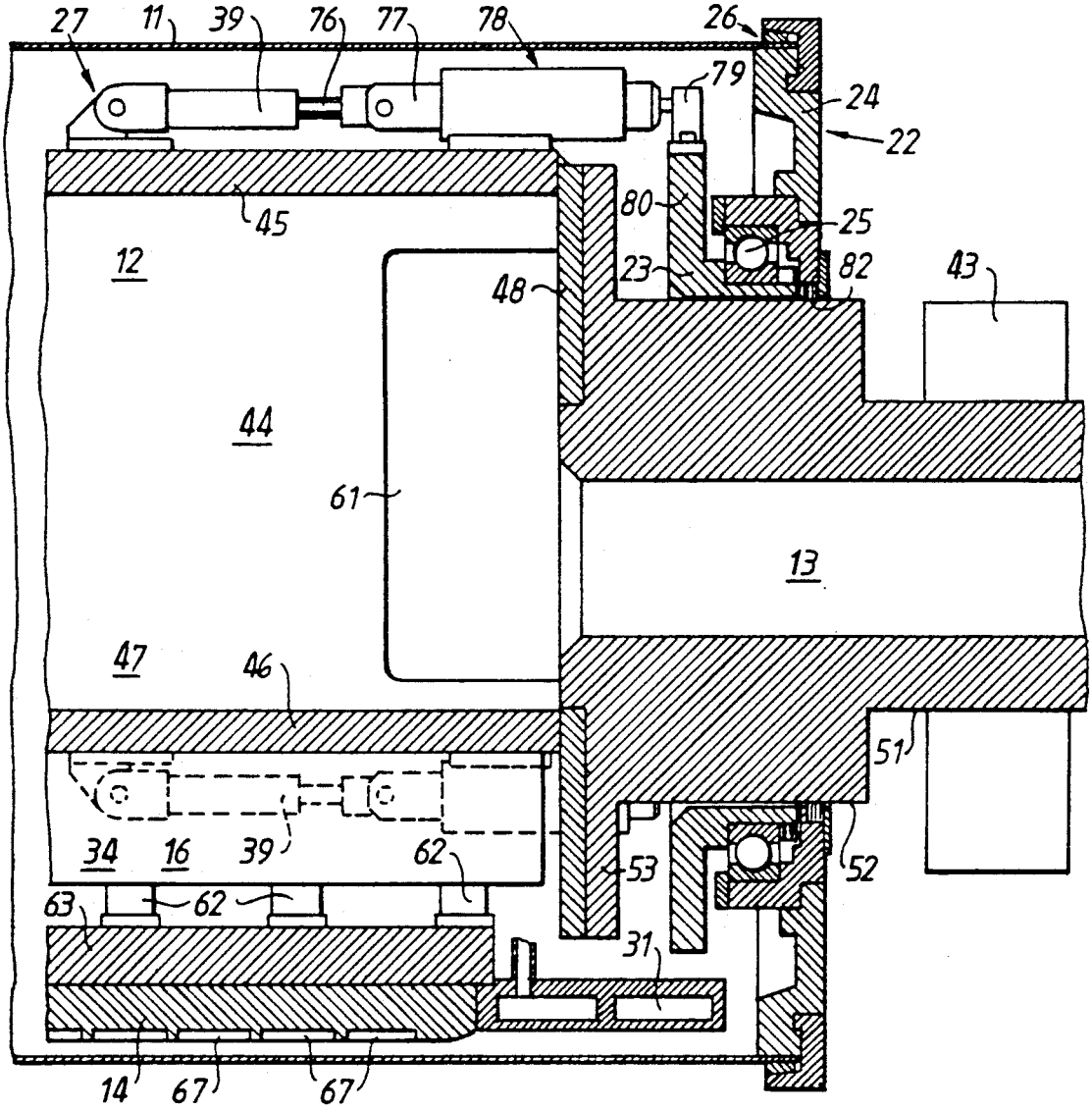

FIGS. 2, 4A and 4B show that the shoe type press roll further has two roll end walls 18 and 22. Both of these are mounted displaceably in axial direction on either stub shaft 13, and both of them have an inner ring member 19 and 23, respectively, an outer ring member 20 and 24, respectively, and a radial bearing 21 and 25, respectively, rotatably journaling the outer member on the inner one. For attaching the axial ends of the jacket 11 to either of the outer rotatable ring members 20 and 24, respectively, fastening means are provided, which are generally indicated with 26 and shown in detail in FIG. 6. In addition, the shoe press roll includes means 27 (FIGS. 2 and 4B) for axially stretching the flexible jacket 11 and means 28 (FIGS. 3 and 4A) for displacing at least one of the roll end walls 18 and 22 axially on the associated stub shaft 13 for facilitating the securing of the flexible jacket 11 to the end wall 18 and 22, respectively.

According to the invention said end wall displacing means 28 are designed to permit a setting of an arbitrary operating position for one end wall, namely end wall 18, between two end positions on the associated stub shaft 13, and said jacket stretching means 27 are designed to maintain the stretching force substantially constant, whereby the other end wall 22 becomes self-positioning and automatically follows every axial displacement of said one end wall 18. Since the flexible jacket 11 can be axially displaced to an arbitrary operating position between two end positions, it becomes possible to displace the jacket 11 axially in relation to the support beam 12 and the shoe 14, after a first operational period, a distance that is sufficient for carrying the most fatigued or worn portion of jacket 11 away from the axial end of shoe 14 and for carrying a jacket portion, which has been exposed to a lower degree of fatigue or wear, forward to said shoe end. This adjustment of the position of the jacket 11 in relation to the support beam 12 and the shoe 14 may be carried out several times until the entire displacement distance between the end positions on the stub shafts 13 has been utilized. In this way a marked increase of the life of the jacket 11 is obtained.

The jacket stretching means preferably include means 29 for pressurizing the flexible jacket 11 by a comparatively low, substantially constant but variable internal pressure above that of ambient atmosphere. Such means may include a source 29 of pressurized air, which in FIG. 2 is shown in the form of an air pump. The overatmospheric pressure can be varied, e.g. by a valve 90 in a pipe branch opening into ambient air. The pressurized air source 29 is able to maintain the jacket 11 inflated to an at least substantially circularly cylindrical shape by supplying pressurized air of such a pressure and in such an amount that the overatmospheric pressure inside the roll will be 0.03–0.1 bars (3–10 kilopascals), for example. An overatmospheric pressure of this size will give an axial stretching force acting on the jacket 11, and at a jacket diameter of 1.4 meters and an end wall inner diameter of 0.7 meters the force will be between 4 and 12 kilonewtons. At the specified upper limit for the overatmospheric pressure, the pressure difference to ambient atmospheric pressure is sufficiently large for drawing off cooling and lubricating oil, which has been removed from the inner side of roll jacket 11 at a bottom region thereof, out of the roll through one of its stub shafts 13. At the lower limit, suction is required, e.g. by sub-atmospheric pressure in a return oil tank 30, which may be connected to a vacuum pump 91 or the like.

The jacket stretching means preferably also include pressure medium operated means 27, which are supplied with constant pressure and are operatively connected between the support beam 12 and the inner ring member 23 of said other end wall 22, for adjusting a force on said other end wall 22 caused by the internal overatmospheric pressure, so as to maintain a predetermined axial tension in the flexible jacket 11 when said one end wall 18 is being displaced as well as when the internal pressure is being adjusted. Thereby, the axial tension in the jacket 11 may be maintained at a selected, suitable level irrespective of the magnitude of the stretching force originating from the internal overatmospheric pressure. Consequently, the pressure medium operated means 27 can act on the end wall 22 with a force that either increases the force from the internal overatmospheric pressure or that counteracts it, all according to what is required.

FIG. 2 schematically shows the pressure medium systems used in the shoe type press roll. Above, we have already mentioned the pressurized air source or the air pump 29, which supplies air of a suitable, predetermined overatmospheric pressure to the interior of the shoe type press roll to maintain the flexible jacket 11 inflated to a substantially circularly cylindrical shape. We have also mentioned the return oil tank 30 for the cooling and lubricating oil. The surplus of cooling and lubricating oil is collected inside the roll at the lowest point of the jacket 11 by means of drainers 31, which in the preferred embodiment are mounted on the axial ends of the shoe 14. At least with long rolls for wide machines it is preferable that along the shoe 14 there are provided additional means for collecting and conducting away cooling and lubricating oil, and such means will be described below with reference to FIG. 3. The collected cooling and lubricating oil is drawn off to the return oil tank 30 through a return conduit extending out through one of the stub shafts 13, both of which are tubular and closed at their ends. After an optional separation of air bubbles and solid particles and after cooling, when required, the cooling and lubricating oil is recirculated by means of the cooling and lubricating oil supplying means 17 to the concave surface portion of the shoe 14. The means 17 include a circulation pump 32 and, if desired, a pressure reducing valve 33 and a flow restrictor, not shown in FIG. 2, located upstream of each outlet for the cooling and lubricating oil.

In the preferred embodiment of the invention shown in the drawings, the hydraulic means 16 for pressing the press shoe 14 against the inner side of the jacket 11 includes a plurality of double-acting hydraulic jacks 34 provided in two parallel rows along and radially inside the leading edge and the trailing edge of the press shoe 14. The jacks 34 suitably are assembled to form hydraulic jack units, in principle of the design disclosed in U.S. Pat. No. 4,917,767, but the two rows of jacks are divided into discrete units. Hydraulic oil from a tank 35 is pressurized by a pump 36 and conducted through a feed conduit back to the hydraulic oil tank 35. A pressure reducing valve 37 provided in the feed conduit controls the force, by means of which the shoe 14 is pressed against the jacket 11. The feed and return conduits are connected to a direction controlling valve 38, so that the pressurized hydraulic oil can be supplied to any side of a piston included in each jack for displacing the shoe 14 in a direction towards or away from the jacket 11. To afford good controllability for the setting of the press shoe 14 the hydraulic system may be of dual-circuit type, so that each of the two rows of jacks 34 has a separate hydraulic system. Alternatively, the hydraulic system may include such branch conduits and valves, not shown, that are necessary.

The pressure medium operated means 27, by which the axial tension in the jacket is maintained constant, includes at least two but preferably three hydraulic actuators 39 connected in parallel. One of the actuators is shown in FIG. 2. Hydraulic oil from a tank 40 is pressurized by a pump 41 and conducted through a branched feed conduit to each of the hydraulic actuators 39. Return oil from the actuators runs through a branched collecting and return conduit back to tank 40. Both of the feed conduit and the return conduit are connected to a direction controlling valve 42, so that the pressurized hydraulic oil can be supplied to any side of a piston included in each of the actuators 39 so as to increase or reduce the axial tension in the jacket 11 caused by the internal overatmospheric pressure. For controlling the pushing or pulling force from the hydraulic actuators 39, a pressure reducing valve, not shown, may be provided downstream of the pump 41 in the feed conduit. It is also possible, but not preferred, to substitute a single common tank, not shown, for the three tanks 30, 35 and 40 and in such a case also to substitute a single common pump, not shown, for the three pumps 32, 36 and 41. In FIG. 2 there is also indicated that the shoe type press roll is supported by two bearing units, generally designated 43, which are mounted one on each of the stub shafts 13. Both of the bearing units 43 include a self-aligning bearing or the like, not shown, which permits the support beam 12 to deflect elastically when loaded while the press shoe 14 remains straight.

As illustrated in FIGS. 3 and 4 the support beam 12, between its stub shafts 13, is a box beam 44 made of heavy metal plate and including a top part 45, a considerably wider bottom part 46, two web parts 47 that extend parallel to each other from box beam end to box beam end and interconnect the top part and the bottom part, and an end wall 48 at each box beam end. At its bottom side the bottom part 46 is provided with a leading wall member 49 and a trailing wall member 50, which extend parallel to each other and to the web parts 47 between the end walls 48 to form a box open downwards, in which the jacks 34 are placed. Substantially triangular braces, not shown, are provided where necessary or suitable for increasing the rigidity of the box beam.

Each stub shaft 13 has an axially outer portion 51 of a certain external diameter, on which the bearing unit 43 is mounted, an axially inner portion 52 of larger external diameter, on which the end wall 18 or 22, respectively, is axially displaceable, and axially inside thereof a flange 53 extending radially outwards. The stub shafts 13 are secured to the box beam 44 in that each flange 53 is fixed to the associated end wall 48 by means of a plurality of screws, not shown, that are equidistantly spaced in the circumferential direction.

Figure 5:
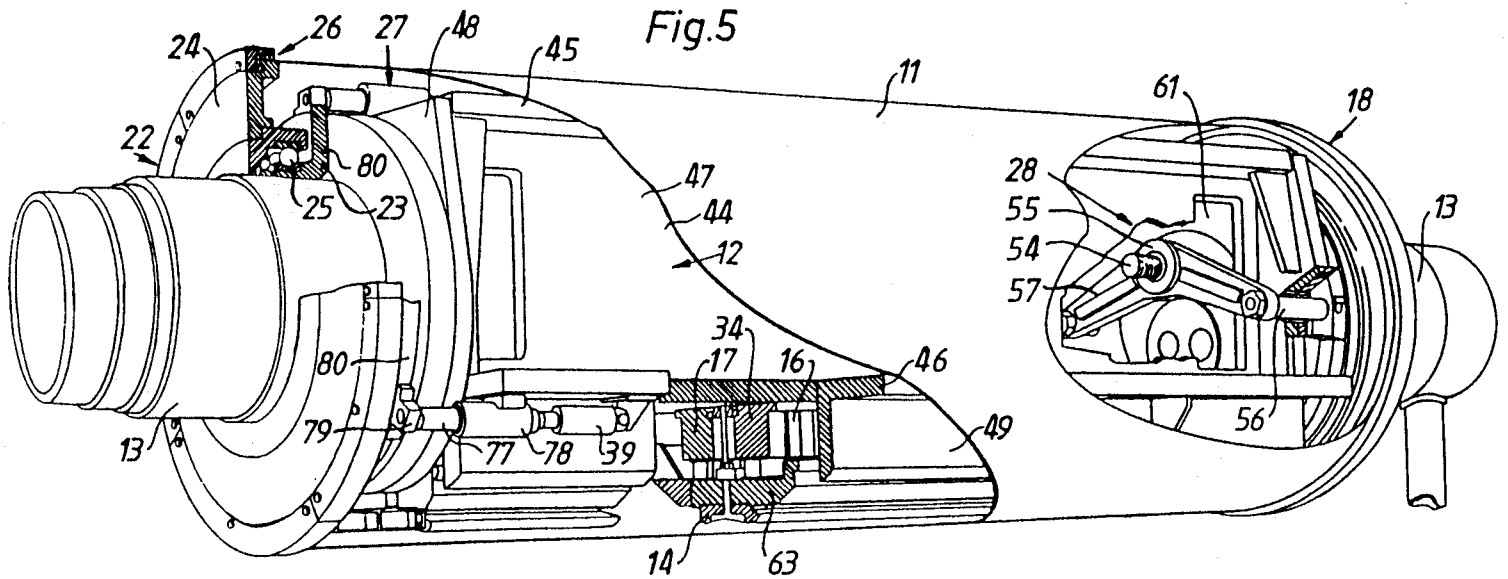
FIG. 5 is a perspective view of the shoe press roll with certain parts of the flexible jacket and interior components broken away for greater clarity.

FIGS. 3 and 4A illustrate that the means 28 for axial displacement of the end wall 18 includes a rotatable operating screw 54 mounted inside the box beam 44, a nut member 55 secured against rotation and movable on the screw 54 upon rotation thereof, two rods 56 fixed to the inner ring member 19 of said one end wall 18 at diametrically opposed positions, suitably in a radially outwards extending flange 58 included in inner ring member 19, and two arms 57, each of which connects one of said rods 56 with the nut member 55, so that a rotation of the operating screw 54 will displace the nut member 55, the arms 57 and the rods 56 and, thereby, also said one end wall 18 axially on the stub shaft 13. The web parts 47 of the box beam 44 are provided with apertures 61 required to permit the arms 57 to be displaced along the inner threaded end of the operating screw 54 upon rotation of the screw. Two bushings 59, which constitute guides for the two rods 56, extend through the end wall 48 of the box beam 44 and the flange 53 of the stub shaft 13. The operating screw 54 is rotatably journaled in the stub shaft 13 and has an outer end 60 extending axially out through a bore provided in the stub shaft 13 and is shaped to be gripped by a drive, not shown, for rotation of the screw 54. The end may have a polygonal cross section, for example, or be provided with a groove for a key, which permits e.g. a manually rotatable hand wheel, not shown, to be fastened to the outer end 60 of the operating screw 54 for axial displacement of the end wall 18 on the stub shaft 13. Preferably, the axially inner portion 52 of the stub shaft 13, on which the end wall 18 is axially displaceable, is of an axial length that is sufficient for permitting that the distance between the end positions of the end wall 18 will be about 0.1 meter. The main components of the end wall displacing means 28 are shown in perspective in FIG. 5.

In addition to the end wall displacing means 28 FIG. 3 shows the hydraulic units 34, which are mounted to the under side of the bottom part 46 of the box beam 44 by means of screws, not shown, and have projecting plungers 62. By means of screws, not shown, the press shoe 14 is mounted on a carrier plate 63, which in turn is connected by means of screws, not shown, to some of the plungers 62. At its leading edge the carrier plate 63 has a longitudinally extending support bulb 64 adapted to cooperate with the inner side of the leading wall member 49 of the box beam 44. At its trailing edge the carrier plate 63 has a longitudinally extending radiused portion 65 adapted to cooperate with a leading edge of a support member 66 that projects forwards from the bottom edge of the trailing wall part 50 of the box beam 44 towards the carrier plate 63. The radiused portion 65 and the support bulb 64 make it possible to obtain support in the machine direction for the press shoe 14 mounted on the carrier plate 63 also in cases when the jacks 34 in the two rows operate in such a manner that the trailing edge of the shoe 14 is loaded more than the leading edge or vice versa. To permit such loading, said screw connection of the carrier plate 63 to some of the plungers 62 is carried our with a clearance of the size required. The other plungers 62 have spherically rounded ends, not shown, which abut the carrier plate either directly or via spherically rounded bearing sockets, not shown.

Preferably, the press shoe 14 is provided with a plurality of hydrostatic pressure pockets generally designated 67 and located side by side to form a row. Of course, it is possible to apply the axial displaceability of the jacket 11 to achieve a longer life of the jacket even if the shoe were of hydrodynamic type, but a shoe having hydrostatic pressure pockets provides an improved cooling and lubrication in the pressing zone, which results in a longer life of the jacket.

Figure 7:
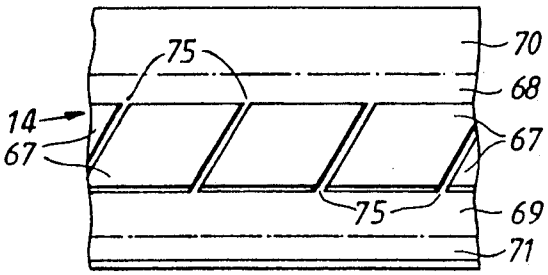
FIG. 7 is a plan view of a part of the press shoe and illustrates that the pressure pockets in an alternative embodiment may extend at an oblique angle over the shoe.

As mentioned above, the press shoe 14 essentially is of the principle design disclosed in U.S. Pat. No. 4,917,768 and, consequently, the hydrostatic pressure pockets 67 are preceded and followed by land surfaces 68 and 69, which in the direction of rotation of the jacket are of a width that is sufficient for making the press shoe 14 be of a combined hydrodynamic and hydrostatic type. The leading edge of the leading load surface 68 merges tangentially into an inlet surface 70, and the trailing edge of the trailing land surface 69 merges tangentially into an outlet surface 71 (FIG. 7). Thus, the pressing zone is formed by the pressure pockets 67, the land surfaces 68 and 69, and a portion of the inlet surface 70, which portion adjoins the leading land surface 68. Any particular arrangement for feeding cooling and lubricating oil to the leading edge of the press shoe 14 is not required though the leading land surface 68 and said adjoining portion of the inlet surface 70 form a hydrodynamic bearing surface. On the contrary, a row of conduits 72, one of which is illustrated in FIG. 3, is provided in the carrier plate 63 immediately upstream of the leading edge of the press shoe 14 for drawing off an excess of cooling and lubricating oil to the return conduit from the drainers 31. In exceptional cases it may be suitable to provide an additional supply of cooling and lubricating oil, not shown, to the inner side of the jacket 11 in order to cool the jacket and thereby maintain its temperature at a level such that the life of the jacket 11 will not be detrimentally affected. In such a case it is usually sufficient that the additional supply of cooling and lubricating oil is effected after the jacket 14 during its rotation has passed its highest point.

A feed line 73 for the supply of cooling and lubricating oil to the hydrostatic pressure pockets 67 is mounted on the top side of the carrier plate 63 in a position between the two spaced rows of the hydraulic units 34. From the feed line 73 a conduit extends to each pressure pocket 67. In each such conduit there is a non-adjustable flow restrictor 74, which may be configured as an elongated axial bore of small diameter through a screw, not shown, inserted in the conduit in order to ensure that each pressure pocket 67 will receive a predetermined oil flow of a predetermined pressure.

An additional increase of the life of the jacket 11 can be achieved in certain cases by using the embodiment illustrated in FIG. 7, wherein the land surfaces 75, which separate adjoining hydrostatic pressure pockets 67 from one another, extend at an oblique angle in relation to a plane perpendicular to the rotational axis of the roll jacket 11. In this way the cooling of the land surfaces 75 will be improved and a thermal expansion of the pocket separating partitions will be avoided or at least reduced. A thermal expansion of these partitions may have the result that the land surfaces 75 rise slightly over the intended shoe surface, whereby the carrying oil film on them will be thinner and a more pronounced generation of heat will set in, which will result in a still more increased thermal expansion and, consequently, an increased wear of the jacket 11. In cases where the land surfaces 75 do not extend at an oblique angle to said plane but instead parallel therewith, an increased life of the jacket 11 can be achieved by adapting the distance that the jacket 11 is axially displaced in each step and the spacing between the land surfaces 75 so to each other, that after each displacement step such jacket portions that have not been exposed to any appreciable degree of wear will be located just opposite the land surfaces 75.

As mentioned above, the pressure medium operated means 27, by which the axial tension in the jacket 11 is maintained constant, include at least two but preferably three hydraulic actuators 39 connected in parallel to one another. These actuators are operatively connected between the support beam 12 and the inner ring member 23 of said other end wall 22. Such a hydraulic actuator is shown in FIG. 4B, and of the other two actuators one is indicated in dashed lines. The hydraulic actuators 39 are mounted axially on the box beam 44 and are spaced by uniform rotational angles in relation to the rotatable roll jacket 11. The top hydraulic actuator 39 is pivotally attached to the top side of the box beam top part 45, and the two bottom actuators are pivotally attached to the bottom side of the box beam bottom part 46, one upstream of the leading wall member 49 and the other downstream of the trailing wall member 50. Each actuator 39 includes a plunger 76 provided with a plunger extension 77. This extension extends through a guide 78, which is mounted onto a flange 80 projecting radially from the inner ring member 23 of said other end wall 22, which is axially displaceable on its associated stub shaft 13. Concerning the locations of the hydraulic actuators 39 and components cooperating therewith, we also refer to the perspective view of FIG. 5.

The two radial bearings 25 and 21 in the roll end walls 22 and 18, respectively, preferably are selected so as to permit a certain limited tilting of the outer ring member 24 and 20, respectively, of the roll end wall in relation to the inner ring member 23 and 19, respectively. In this way a difference in tension in the flexible jacket at the pressing zone and at a diametrically opposite location is reduced, which contributes to increasing the life of the flexible jacket 11. As a rule, standard deep-groove ball bearings are adequate. Such bearings can easily stand a tilt angle of 10 minutes, which at a jacket diameter of 1.44 m corresponds to a length of about 2 mm at each end wall. If a larger tilting is desired, anyone of the solutions disclosed in Swedish Patent Application No. 9000147-0, publication No. 464 032, can be used.

Figure 6:
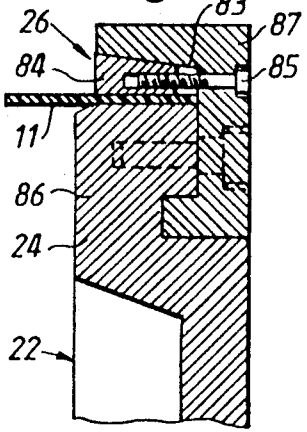
FIG. 6 is a section from FIG. 4B on a larger scale for illustrating more in detail how the flexible jacket is attached to the roll end wall.

Axially outside the bearings 25 and 21 the outer ring members 24 and 20 of the roll end walls 22 and 18, respectively, extend radially inward and each of them is provided at its inner periphery with a seal ring 82 and 81, respectively, which engages the respective stub shaft 13 and prevents oil and pressurized air from leaking out. FIG. 6 shows the fastening means for securing the jacket 11 to the end wall 22. Even though the fastening means are described only in connection with end wall 22 it is understood that they are of identical design for end wall 18. The fastening means 26 include end wall portions defining a circular groove 83 provided on the inside of the outer ring member 24 of the roll end wall 22 for receiving the edge portion of the flexible jacket 14, and a plurality of circularly arched locking elements 84, one of which is shown. The groove 83 and each of the locking elements 84 are provided with cooperating tapered surfaces. Means, suitably configured as screws 85, of which one is shown, are provided for pulling the locking elements 84 into the groove 83 and retaining them therein in order to clamp the edge portion of the jacket 11 in the roll end wall 22 by wedge action. In the preferred embodiment illustrated in FIG. 6, the groove 83 tapers inwardly towards its bottom, and a major portion of a radially inner side wall of the groove 83 is parallel to the roll jacket 11. At the open side of the groove 83 the inner side wall merges into a tapered portion for facilitating the entry of the edge portion of the jacket 11 into the groove 83.

Figure 8:
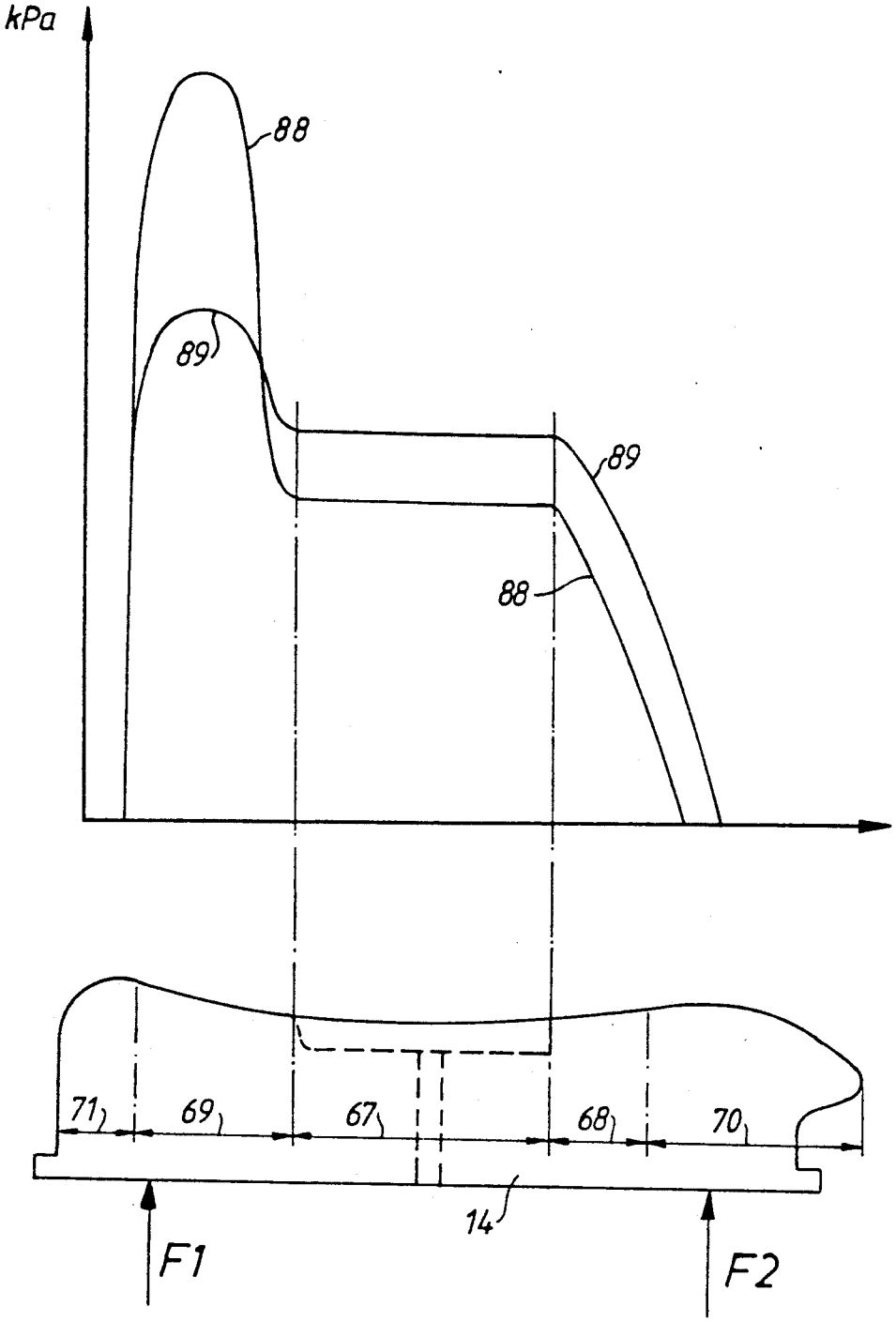
FIG. 8 is a diagram showing the variation in nip pressure across the press shoe.

It is also advisable, as shown in FIG. 6, that the outer ring member 24 of the end wall 22 includes a radially inner ring 86 and an outer ring 87, preferably segmented to form a plurality of identical circularly arched sections. The ring 87 is of a substantially L-shaped cross section and is screwed onto the inner ring 86 to form the groove 83 between the inner ring 86 and an axially extending collar of the outer ring 87. A radially inward extending flange of the outer ring 87 has an axially protruding projection, and the inner ring 86 has a matching recess for locating the two rings 86 and 87 radially in relation to each other. Thereby, the stress acting on the flexible jacket 11 at its ends will be reduced, the jacket will be easier to mount and a replacement of the jacket will be facilitated. FIG. 8 illustrates two different nip pressure profiles 88 and 89 obtained upon different loading of the leading edge and the trailing edge of the press shoe 14 by means of the two rows of jacks 34. The load at the trailing edge is designated F1 and the load at the leading edge is designated F2. The profile curve 88 is obtained at a ratio F1/F2 of 1.8 and is initially lower but has towards its end a higher hump than the profile curve 89, for which the ratio F1/F2 is 1.3.

From FIG. 8 it is also clear that the pressing starts and the nip pressure begins to rise already in the trailing portion of the inlet surface 70, continues to rise along the load surface 68, is constant over the pressure pocket 67, and thereafter rises to a marked top over the load surface 69 and goes down to zero at the transition to the outer surface 71. By adapting F1 and F2 to each other it is, consequently, possible to achieve a nip pressure profile of the shape that is best suited for the paper web, from which water is to be pressed out.

The invention is not restricted to the preferred embodiment described above and illustrated in the drawings but can be varied within the scope of the appended claims. For instance, instead of consisting of a single integrated unit, the press shoe 14 may be composed of a group of individual press shoe elements, each of which may be associated with a separate jack 34. In such an embodiment the phrase "the axial ends of the press shoe 14" shall be regarded as referring to the axial ends of the group of press shoe elements.

What is claimed is:

1. A press roll having (a) a rotatable, liquid impermeable flexible roll jacket;

(b) a stationary non-rotatable support beam extending axially through the roll jacket and having a stub shaft at each end;

(c) at least one press shoe supported by the support beam and having a concave surface portion;

(d) hydraulic means for pressing the concave surface portion of the shoe against the flexible jacket to make the jacket together with a counter roll form a press nip extended in the direction of rotation of the jacket;

(e) means for supplying a coolant and lubricant to a surface of the shoe bearing against the jacket;

(f) two roll endwalls, which are axially displaceable on each of the stub shafts, and both of which have an inner ring member, an outer ring member and a radial bearing for journaling the outer member rotatably on the inner one;

(g) fastening means for securing the axial ends of the jacket to each of the outer rotatable end wall members;

(h) means for axially stretching the flexible jacket; and (i) means for displacing one of the end walls axially on the associated stub shaft for facilitating the securing of the flexible jacket to the end wall; said end wall displacing means being structured and arranged to permit settings of arbitrary operating positions for said one end wall between two end positions on the associated stub shaft; and (j) said jacket stretching means being structured and arranged to maintain a substantially constant stretching force, said jacket stretching means with said press roll being structured and arranged so that the other of said end walls is self-positioning and automatically follows every axial displacement of said one end wall.

2. A press roll according to claim 1, wherein said jacket stretching means includes means for pressurizing the flexible jacket by a comparatively low internal pressure above that of the ambient atmosphere.

3. A press roll according to claim 2, wherein said jacket stretching means further includes pressure medium operated means, which are supplied with constant pressure and are operatively connected between said support beam and said inner ring member of said other end wall, for adjusting a force on said other end wall caused by the internal pressure so as to maintain a predetermined axial tension in the jacket when said one end wall is being displaced as well as when the internal pressure is being adjusted.

4. A press roll according to claim 3, wherein said pressure medium operated means includes at least two hydraulic actuators connected parallel to each other and mounted axially on the support beam, said actuators being spaced by equal size angles of rotation in relation to said rotatable roll jacket, said actuators including piston rods, each of said piston rods being provided with a piston rod extension, each piston rod extension extending through a guide mounted axially on the support beam, and the inner ring member of said other end wall having a radially outwards extending flange, to which the piston rod extensions are attached.

5. A press roll according to claim 1, wherein said support beam includes a box portion extending between said stub shafts, and wherein said end wall displacing means includes a rotatable operating screw mounted axially inside the box portion, a nut member secured against rotation and movable on said operating screw, two rods fixed to the inner ring member of said one end wall at diametrically opposed positions and extending axially into said box portion up to the nut member, and two arms, each of which connects one of said rods with the nut member, so that a rotation of the operating screw will displace the nut member, the arms and the rods and, thereby, also said one end wall axially on the stub shaft.

6. A press roll according to claim 5, wherein said operating screw has an outer end extending axially out through a hole provided in the stub shaft, said screw end being shaped for engagement by a drive means for rotating the screw.

7. A press roll according to claim 5, wherein said box portion has an end wall, and said stub shaft has a radial flange screwed onto the box beam end wall, and two guide bushings for the two rods extending through the box portion end wall and the flange.

8. A press roll according to claim 1, wherein said fastening means for securing the axial ends of the jacket to each of the outer rotatable end wall members include end wall portions defining a circular groove provided in the inner side of the outer ring member of each of the two end walls for receiving the edge portion of the flexible jacket, and a plurality of circularly arched locking elements, said groove and each of said locking elements being provided with cooperating tapered surfaces, and means for pulling the locking elements in to the groove and retaining them therein in order to clamp the edge portion of the jacket in the roll end wall by wedge action.

9. A press roll according to claim 8, wherein said groove tapers inwardly towards its bottom, at least a major portion of a radially inner side wall of the groove being parallel to the roll jacket.

10. A press roll according to claim 9, wherein the outer ring member of each of the two roll end walls includes a radially inner ring and an outer ring, which is segmented to form a plurality of identical circularly arched sections and is of a substantially L-shaped cross section and is attached by screws to the inner ring to form said groove between the inner ring and an axially extending collar of the outer ring, a radially inward extending flange of the outer ring having an axially protruding projection, and the inner ring having a matching recess for locating the two rings radially relative to each other.

11. A press roll according to claim 1, wherein said radial bearing is selected so as to permit a certain limited tilting of the outer ring member of the roll end wall in relation to the inner ring member thereof, whereby a difference in tension in the flexible jacket at the pressing zone and at a diametrically opposite location is reduced.

12. A press roll according to claim 1, wherein said press shoe has a plurality of hydrostatic pressure pockets located side by side.

13. A press roll according to claim 12, including land surfaces located upstream and downstream of the hydraulic pressure pockets in relation to the direction of rotation of the jacket, said land surfaces having in said direction a width that is sufficient to make the press shoe be of a combined hydrostatic and hydrodynamic type.

14. A press roll according to claim 12, including land surfaces separating adjacent pockets and extending at an oblique angle to a plane perpendicular to the rotational axis of the roll jacket.

* * * * *

UNITED STATES PATENT AND TRADEMARK OFFICE

CERTIFICATE OF CORRECTION

PATENT NO. : 5,084,137

DATED : January 28, 1992

INVENTOR(S) : Antti I. Ilmarinen et al.

It is certified that error appears in the above-identified patent and that said Letters Patent is hereby corrected as shown below:

Column 2, line 52, "sure" should be -- pressure --.

Column 4, line 62, insert -- 1 -- before "illustrated".

Column 9, line 31, insert -- 11 -- after "jacket".

Column 10, line 57, insert -- 11 -- after "jacket".

Column 13, line 22, "beam" should be -- portion --.

Signed and Sealed this

Seventh Day of September, 1993

Bruce Lehman

*Attest:*

BRUCE LEHMAN

*Attesting Officer*

*Commissioner of Patents and Trademarks*